US006186350B1

(12) United States Patent
Barrier et al.

(10) Patent No.: US 6,186,350 B1
(45) Date of Patent: Feb. 13, 2001

(54) BOX MADE UP OF BOX ELEMENTS JOINED TOGETHER IN A RELEASABLE AND ARTICULATED MANNER, IN PARTICULAR FOR LIGHT FITTINGS

(75) Inventors: Emmanuel Barrier, Jourgnac; Jean-Jacques Domingues, Limoges, both of (FR)

(73) Assignees: Legrand; Legrand SNC, both of Limoges (FR)

( * ) Notice: Under 35 U.S.C. 154(b), the term of this patent shall be extended for 0 days.

(21) Appl. No.: 09/260,485

(22) Filed: Mar. 2, 1999

(30) Foreign Application Priority Data

Mar. 2, 1998 (FR) ..... 98 02475

(51) Int. Cl.[7] ..... B65D 43/00

(52) U.S. Cl. ..... 220/4.22; 220/836; 220/840; 220/841

(58) Field of Search ..... 220/4.22, 836, 220/840, 841, 4.24

(56) References Cited

U.S. PATENT DOCUMENTS

| | | | | |
|---|---|---|---|---|
| 3,663,990 | * | 5/1972 | Shane | 220/836 X |
| 4,282,983 | | 8/1981 | Swartzbaugh | 220/335 |
| 4,349,120 | * | 9/1982 | DiNardo | 220/337 |
| 4,549,670 | * | 10/1985 | Trendler | 220/338 |
| 5,505,328 | * | 4/1996 | Stribiak | 220/4.24 X |
| 5,529,205 | | 6/1996 | Corney et al. | 220/342 |
| 5,577,628 | | 11/1996 | O'Neil et al. | 220/343 |

FOREIGN PATENT DOCUMENTS

| | | | |
|---|---|---|---|
| 4303784 | 8/1983 | (DE) | B65D/1/22 |
| 0798227 | 10/1997 | (EP) | B65D/43/16 |
| 2264105 | 8/1993 | (GB) | B65D/43/16 |

* cited by examiner

*Primary Examiner*—Steven Pollard
(74) *Attorney, Agent, or Firm*—Young & Thompson

(57) ABSTRACT

A box comprises two box elements attached together at a contact surface and connected together in a releasable manner in each of two opposite assembly areas. Each box element includes in each assembly area at least one clipping member which hooks onto a complementary clipping member in corresponding relationship to it on the other box element and at least one journal member which cooperates pivot fashion with a complementary journal member in corresponding relationship to it on the other box element. At least the clipping member of at least one of the box elements is carried by an elastically deformable arm. Applications include boxes for light fittings.

26 Claims, 3 Drawing Sheets

BOX MADE UP OF BOX ELEMENTS JOINED TOGETHER IN A RELEASABLE AND ARTICULATED MANNER, IN PARTICULAR FOR LIGHT FITTINGS

BACKGROUND OF THE INVENTION

Field of the Invention

The present invention concerns boxes of the kind having two box elements joined together at a contact surface and together defining a housing of any kind and which are joined together in a releasable manner in each of two opposite assembly areas.

Applications of such boxes include light fittings in which, for maintenance reasons, it is frequently desirable to have relatively easy, but nevertheless controlled, access to their interior.

One of the box elements constituting a box of the above kind then constitutes a base adapted for fixing the assembly to a support of any kind and the other box element constitutes a glass, for example, operative in the manner of a cover relative to the base.

A general object of the present invention is an arrangement providing easy and controlled access in a simple and effective manner to the interior volume of boxes of the above type, and also having other advantages.

SUMMARY OF THE INVENTION

To be more precise, the present invention consists in a box comprising two box elements attached together at a contact surface and connected together in a releasable manner in each of two opposite assembly areas, each box element including in each assembly area at least one clipping member adapted to hook onto a complementary clipping member in corresponding relationship thereto on the other box element and at least one journal member adapted to cooperate pivot fashion with a complementary journal member in corresponding relationship thereto on the other box element, wherein at least the clipping member of at least one of the box elements is carried by an elastically deformable arm.

Accordingly the invention associates, in each of the assembly areas between the two box elements, on the one hand, clipping means whereby the box elements can be very easily and quickly joined together, by simple forcible engagement of one on the other, and, on the other hand, journal means enabling the assembly to be opened, if required, without completely separating the two box elements from each other, separating them on one side only and leaving them articulated to each other on the other side.

However, in both cases, whether the separation is on one side only or on both sides, it requires the use of a tool, even if only a screwdriver blade, to operate accordingly on the elastically deformable arm carrying the corresponding clipping member.

It is therefore impossible for anyone without such a tool to separate them and therefore to open the assembly, which is a very simple way of assuring compliance with applicable standards if the box concerned is part of a light fitting.

What is more, both assembly areas of the box in accordance with the invention have clipping means and journal means and each can therefore serve interchangeably and alternately as an opening area or an articulation area, with the result that the box can advantageously be opened from either side.

Finally, because the elastically deformable arm tends to move the box elements between which it operates apart, each assembly area advantageously allows the box in accordance with the invention to be opened wide.

It can preferably be opened to at least 180°.

In a simplified embodiment of the invention the journal member of the box element whose clipping member is carried by an elastically deformable arm is in one piece with the clipping member.

Alternatively, in a preferred embodiment of the invention, the journal member is dissociated from the clipping member and forms a separate part.

In this way it is advantageously possible to optimize the clipping and articulation functions individually.

Because of such dissociation, it is advantageously possible, when one box element is joined to the other, or when it is separated therefrom on both sides, for only the clipping means to be involved, which facilitates their intervention when fitting and when removing it, and when the assembly is opened on one side only the journal means on the other side immediately assume the corresponding assembly function, which assures a permanent assembly function, without risk of unintentional separation of the box elements on this other side.

The features and advantages of the invention will become apparent during the course of the following description given by way of example with reference to the accompanying diagrammatic drawings.

DETAILED DESCRIPTION OF THE PREFERRED EMBODIMENTS

Figure 1:
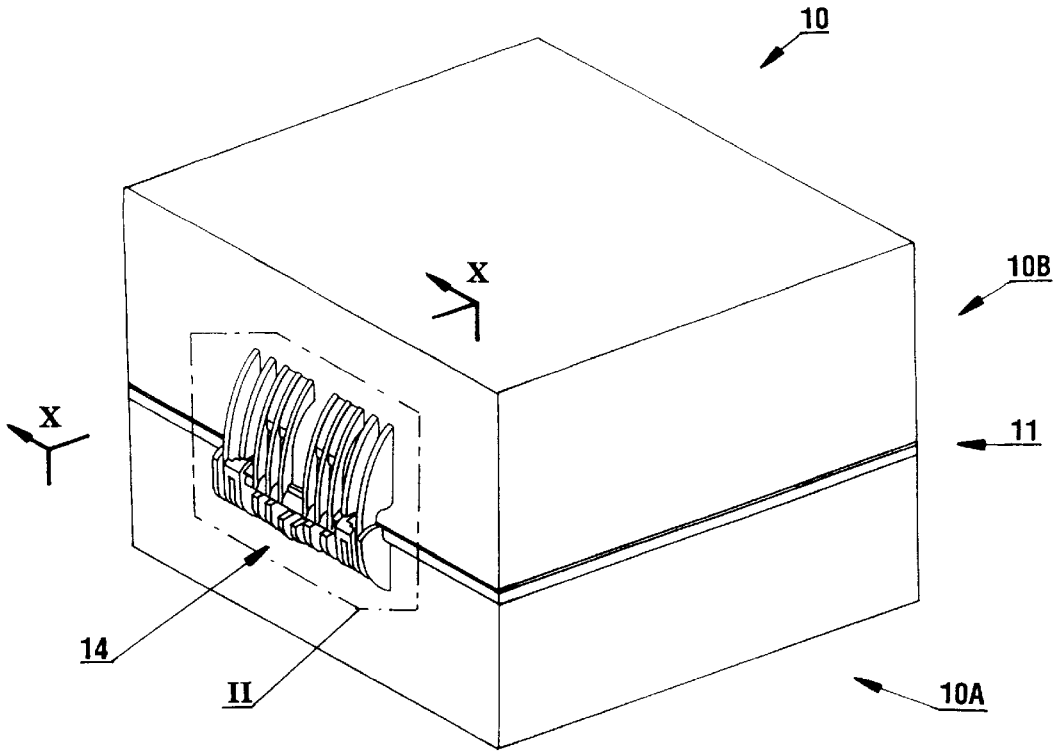
FIG. 1 is a perspective view of a box in accordance with the invention.
Figure 2:
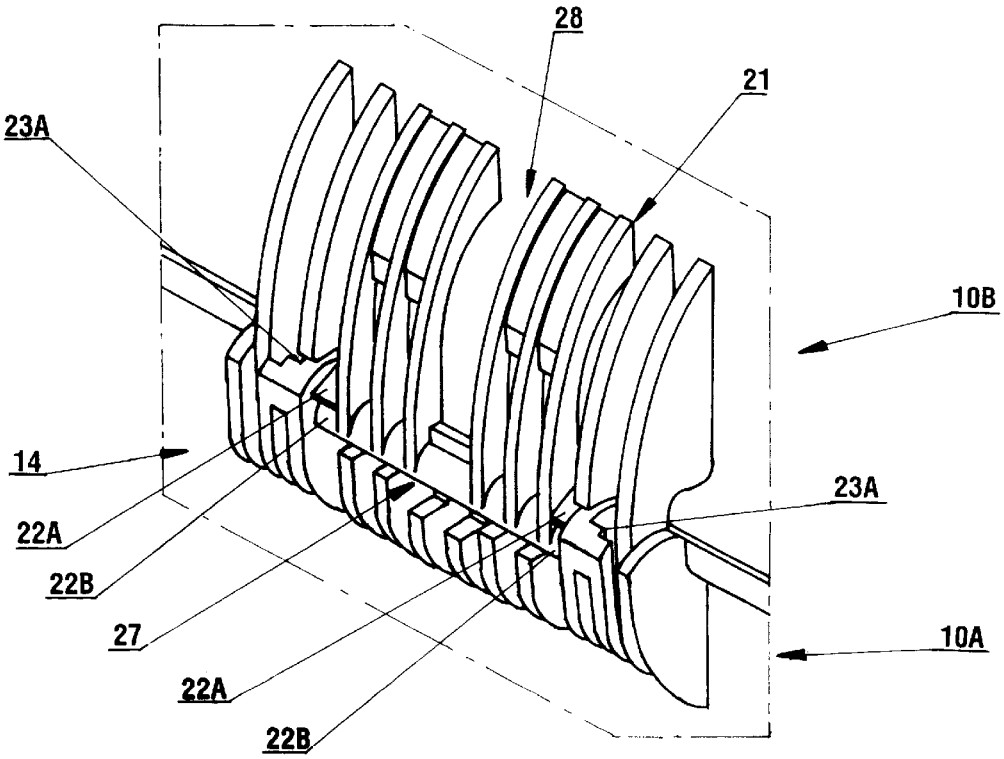
FIG. 2 shows to a larger scale the detail II from FIG. 1, which relates to one of the assembly areas operative between the two box elements constituting the box.

As shown in the figures, the box 10 in accordance with the invention is of the kind having two box elements 10A, 10B attached together at a contacting surface 11, conjointly defining a housing 12 of any kind, and joined together releasably in each of two opposite assembly areas 14.

It is a light fitting box 10, for example.

The box element 10A then constitutes a base which it adapted to enable the assembly to be attached to a support of any kind and the box element 10B then conjointly constitutes a glass, operative in the manner of a cover.

For convenience, it is supposed in the figures that the box 10 has a globally parallelepiped shape and that the two box elements 10A, 10B that constitute it are of substantially the same size about a contact surface 11 which is substantially plane.

Obviously this is not necessarily the case, however, in particular with regard to the general shape of the box 10.

The box elements 10A, 10B will not be described in complete detail here.

Suffice to say that, in the embodiments shown, the box element 10A forms, externally, projecting from its side wall, in the vicinity of its opening 15, but slightly set back relative thereto, a channel 16 which runs all around it, being open on the same side as the contact surface 11, to serve as a housing for a gasket 17, and the free edge of which forms part of the contact surface 11; conjointly, the box element 10B forms, around all of its perimeter, at its own opening 18, in corresponding relationship to the channel 16 on the box element 10A, a tongue 19 by which it is adapted to compress the gasket 17, and, externally, projecting from its side wall, a flange 20 which, adapted to be pressed onto the free edge of the channel 16 of the box element 10A, like the latter, is part of the contact surface 11 and, in practice, is locally interrupted in each of the two assembly areas 14.

In the embodiments shown, the two assembly areas 14 are operative back-to-back in the middle area of two opposite faces of the box elements 10A, 10B, for example in the middle area of their smaller faces, each extending on either side of the contact surface 11.

The two assembly areas 14, only one of which can be seen in the figures, are preferably identical.

Only one of them is described here for this reason.

In accordance with the invention, each box element 10A, 10B includes in each assembly area 14, on the one hand, at least one clipping member 22A, 22B by means of which it is adapted to hook onto a complementary clipping member 22B, 22A in corresponding relationship thereto on the other box element 10B, 10A and, on the other hand, at least one journal member 23A, 23B by means of which it is adapted to cooperate pivot fashion with a complementary journal member 23B, 23A also in corresponding relationship thereto on the other box element 10B, 10A; at least the clipping member 22A, 22B of at least one of the box elements 10A, 10B is carried by an elastically deformable arm 24.

In the embodiments shown only the clipping member 22B of the box element 10B is carried by an elastically deformable arm 24, and is at its end.

The clipping member 22A of the other box element 10A, 10B, here the box element 10A, is rigidly joined to the box element.

In the embodiments shown, there are in practice two clipping members 22B in each of the two assembly areas 14, at the end of a common elastically deformable arm 24 on the box element 10B concerned, with two complementary clipping members 22A in corresponding relationship thereto on the other box element 10A, 10B, here the box element 10A.

As shown here, for example, the two clipping members 22B extend back-to-back at the free end of the elastically deformable arm 24 that carries them.

As in the embodiments shown, the elastically deformable arm 24 is preferably joined to the box element 10A, 10B that carries it, here the box element 10B, at a distance from the contact surface 11, and extends cantilever fashion toward that surface.

As shown here, for example, the elastically deformable arm 24 extends beyond the contact surface 11 and therefore beyond the flange 20 of the box element 10B.

In practice, in the embodiments shown, the elastically deformable arm 24 even extends beyond the free edge of the tongue 19 of the box element 10B.

In the embodiments shown the elastically deformable arm 24 is divided into parallel flanges 26 which are joined together at their free end by a common crosspiece 27.

As shown here, for example, six flanges 26 constitute the elastically deformable arm 24 and are divided into two groups of three, with a sufficient gap 28 between the two groups, for reasons that will become apparent hereinafter, to allow the insertion of a tool of any kind, not shown.

In the embodiments shown, the flanges 26 of the same group are joined together in pairs by spaces 29 over a fraction of their length, starting from their root.

In practice the flanges 26 constituting the elastically deformable arm 24 are perpendicular to the side wall of the box element 10B and perpendicular to the contact surface 11; conjointly the crosspiece 27 joining the flanges 26 is parallel to the side wall of the box element 10B and parallel to the contact surface 11.

In the embodiments shown, the clipping members 22B carried by the elastically deformable arms 24 are studs projecting laterally at the free end of the elastically deformable arm 24, each consisting of the respective corresponding end of the crosspiece 27 at this location.

In the embodiments shown there are two journal members 23A, 23B on each of the box elements 10A, 10B in each of the two assembly areas 14.

In the embodiment more particularly shown in FIGS. 1 through 13 the journal members 23B of the box element 10B whose clipping members 22B are carried by an elastically deformable arm 24 are dissociated from the clipping member 22B and so form separate parts.

Likewise, in this embodiment, the clipping members 22B, on the one hand, and the journal members 23B, on the other hand, can advantageously have different profiles.

In the embodiment shown in FIGS. 1 through 12 the studs forming the clipping members 22B carried by the elastically deformable arm 24, i.e. the studs forming the clipping members 22B of the box element 10B, have a globally quarter-cycle profile in cross section with a curvilinear side 30 which extends from the side opposite the side wall of the box element 10B, a flat 31 parallel to the contact surface 11 and, at right angles thereto, a flat 32 extending from the same side as the side wall of the box element 10B.

Figure 5:
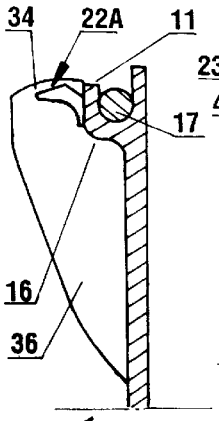
FIGS. 5, 6 and 7 are partial views of the box element in cross section taken along the respective lines V—V, VI—VI and VII—VII in FIG. 4.
Figure 6:
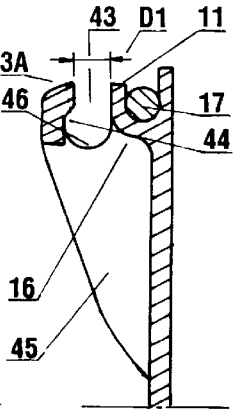
Figure 7:
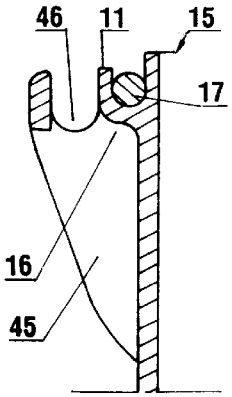

The clipping members 22A of the other box element 10A, 10B, here the box element 10A, have a globally canopy-shape profile in cross section and, as seen better in FIG. 5, for example, in the case of one of them, extend substantially parallel to the contact surface 11.

As shown here, at their top surface, i.e. at the contact surface 11, the clipping members 22A are preferably softened by an insertion profile 34 extending generally obliquely toward their free end.

This profile is a rectilinear chamfer or a curved profile, for example.

In the embodiments shown the clipping members 22A of the box element 10A in fact have on their top surface a dihedral profile with the point directed toward the contact surface 11.

In this embodiment, the clipping member 22A of the box element 10A have, in cross section, on their bottom surface, i.e. on the side opposite the contact surface 11, a circular arc profile subtending an angle of substantially 90° and whose concave side faces away from the contact surface 11, at substantially 45° thereto.

In the embodiments shown, the outermost side of each clipping member 22A laterally adjoins a fixed flange 36 which stiffens it.

In practice the clipping members 22A are spaced apart and face each other on their respective flanges 26 and, at the same level, both are globally set back relative to the contact surface 11.

In the embodiment shown, a boss 37 is provided between the clipping members 22A and, to brace the between the clipping members 22A and, to brace the crosspiece 27 of the elastically deformable arm 24 of the box element 10B, forms a circular arc shape shoulder 38 parallel to the contact surface 11 and at a lower level than the clipping members 22A.

In the embodiment shown the boss 37 is in practice divided into parallel flanges 39 offset relative to the flanges 26 forming the elastically deformable arm 24 of the box element 10B, so that they can be interleaved therewith.

The crosspiece 27 of the elastically deformable arm 24 of the box element 10B is stiffened by a rib 40 in the gap 28 and the flanges 39 in the middle area of the boss 37 on the box element 10A are of reduced height so as not to interfere with the rib 40.

In the embodiment shown each of the journal members 23B on the box element 10B is a stud projecting laterally on an individual support arm 41.

The support arm 41 is preferably rigid.

To this end it is rooted over all of its height to the side wall of the box element 10B from the flange 20 thereof.

In the embodiment shown, the support arm 41 carrying a journal member 23B in this way in practice has the same configuration as the flanges 26 constituting the elastically deformable arm 24 carrying the clipping members 22B, and is parallel to them.

Because two journal members 23B are provided, there are in practice two support arms 41 and they lie on respective opposite sides of the elastically deformable arm 24 carrying the clipping members 22B, at a distance from the elastically deformable arm 24.

In the embodiment shown, the studs forming the journal members 23B have a globally circular profile in cross section and, in corresponding relationship, they each have on the side opposite the side wall of the box element 10B a flat 42 substantially perpendicular to the contact surface 11.

The studs forming the journal members 23B of the box element 10B are in practice coaxial with the studs forming the clipping members 22B of the box element 10B and extend in opposite directions.

In other words, unlike the two clipping members 22B, which are back-to-back, the two journal members 23B extend toward each other.

For each of the journal members 23B on the box element 10B the journal member 23A of the other box element 10A, 10B, here the box element 10A, has a rounded shoulder 44 at the edge of an insertion passage 43 parallel to the contact surface 11, at the end of the insertion passage 43 opposite the contact surface 11, with its concave side facing toward the side wall of the box element 10A, oriented at substantially 45° to the contact surface 11.

In practice the journal member 23A is at a distance from the side wall of the box element 10A and substantially parallel to that side wall, and in the manner of a bridge or a spacer it extends between, on the one hand, the side of the corresponding flange 36 opposite that on which a clipping member 22A operates and, on the other hand, a flange 45 parallel to the flange 36, being in one piece with both flanges 36 and 45.

The flange 45, which has a configuration similar to that of the flange 36, has on its edge on the same side as the contact surface 11 a U-shape notch 46 (see FIG. 6) the back of which forms a cradle for the corresponding journal member 23B of the box element 10B.

Figure 8:
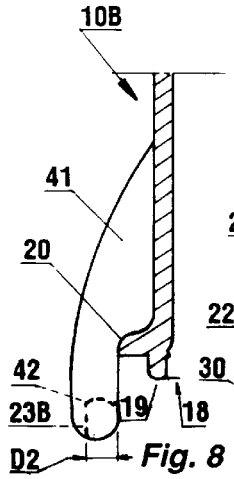
FIGS. 8 and 9 are partial views of the other box element in cross section taken along the respective lines VIII—VIII and IX—IX in FIG. 3.
Figure 9:
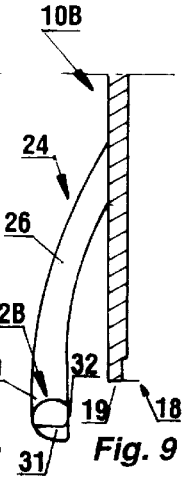

In practice, the distance D1 between the channel 16 and the journal member 23A is substantially equal to (slightly greater than) the dimension D2 of the journal member 23B in line with its flat 42 (see FIG. 8).

Finally, in the embodiment shown, the box element 10A also carries, beyond the flanges 45, flanges 47 for guiding the support arms 41 carried by the box element 10B which are parallel to the flanges 45 and, like them, have a configuration analogous to that of the flanges 36 and 39.

Figure 3:
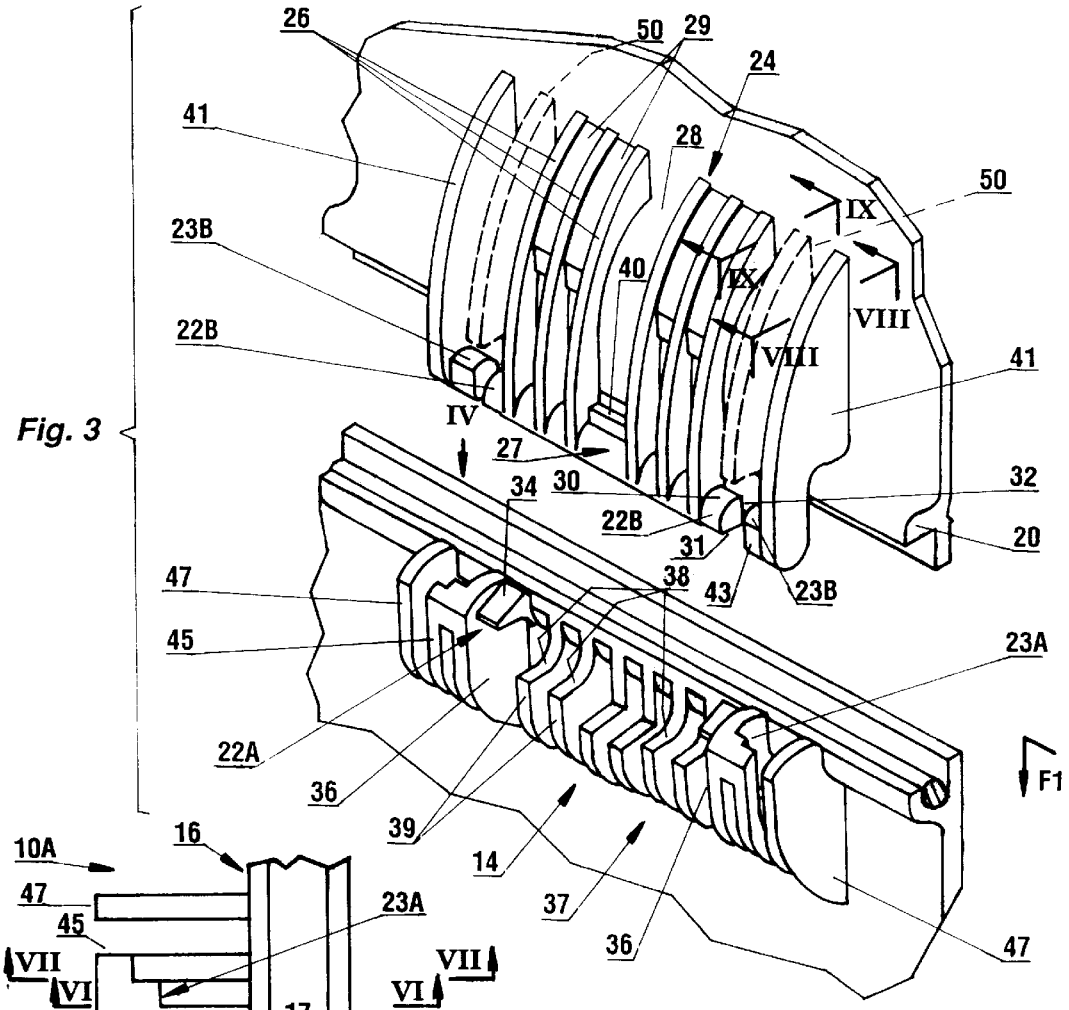
FIG. 3 is an exploded perspective view of the assembly area.
Figure 4:
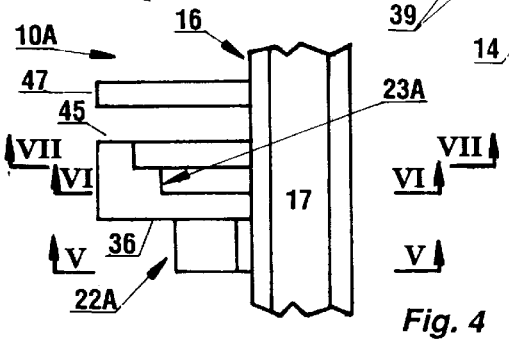
FIG. 4 is a partial top view of one of the box elements in the assembly area, to a larger scale and as seen in the direction of the arrow IV in FIG. 3.

As symbolized by an arrow F1 in FIG. 3, the box 10 in accordance with the invention is assembled by simply engaging one of its box elements 10A, 10B forcibly with the other.

On completing this engagement, which is facilitated by the insertion profile 34 of the clipping members 22A of the box element 10A, the clipping members 22B of the box element 10B engage under the clipping members 22A, by virtue of temporary elastic deformation of the elastically deformable arm 24 carrying them.

Figure 10:
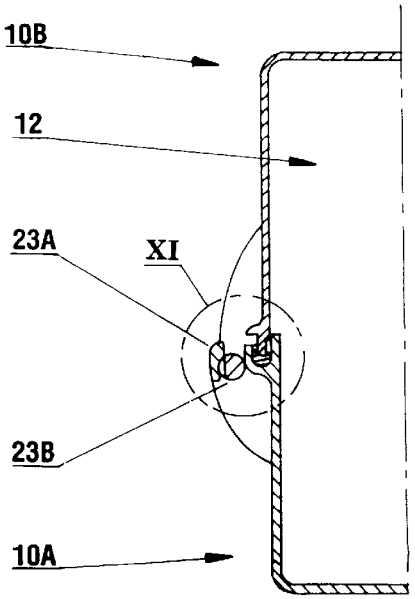
FIG. 10 is a partial view of the box in accordance with the invention shown in the closed position and in cross section taken along the line X—X in FIG. 1.
Figure 11:
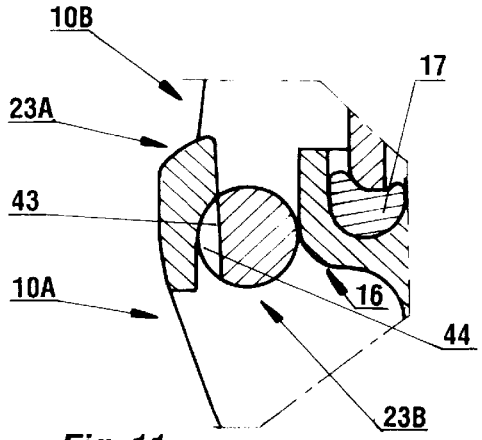
FIG. 11 shows to a larger scale the detail XI from FIG. 10.

At the same time, by virtue of their flat 42, the journal members 23B of the box element 10B engage between the journal members 23A of the box element 10A and the channel 16 thereof until they align with the rounded shoulder 44 of the journal members 23A, as can be seen in the case of one of them in FIGS. 10 and 11.

Because of the interconnection of the clipping members 22A, 22B, the box elements 10A, 10B are then fastened together in each of their assembly areas 14.

They are separated at one or both of the assembly areas 14, according to whether they are to be totally or partly separated.

In either case this requires temporary elastic deformation of the elastically deformable arm 24 carrying the clipping members 22B of the box element 10B so that, by a movement which is the converse of the previous one, the clipping members 22B can escape from the clipping members 22A of the box element 10A.

A tool is needed for this, however, as mentioned above.

This tool, which can simply be a screwdriver blade, is inserted between the crosspiece 27 carried by the elastically deformable arm 24 and the side wall of the box element 10B, by virtue of the gap 28 provided for this purpose, and bears on that side wall to apply leverage to the crosspiece 27.

Figure 12:
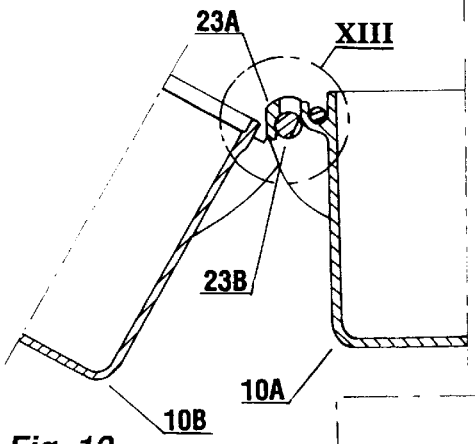
FIGS. 12 and 13 are views respectively analogous to those of FIGS. 10 and 11 showing the open position of the box in accordance with the invention.
Figure 13:
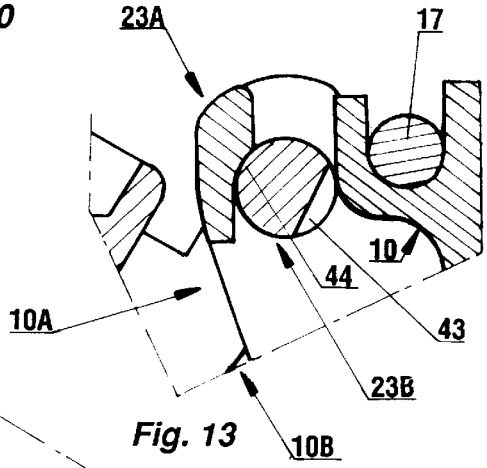

When only partial separation is required, i.e. separation in only one of the assembly areas 14, the other assembly area 14 advantageously acts like a hinge, enabling the box 10 to be opened on one side only, as shown in FIGS. 12 and 13.

At the commencement of opening, the journal members 23A of the box element 10A engage under the journal members 23B of the box element 10B by virtue of the rounded shoulder 44, as shown for one of them in FIGS. 12 and 13, so holding the two box elements 10A, 10B interengaged with each other, without risk of them separating unintentionally at this point.

As shown here, the box 10 in accordance with the invention can advantageously open to more than 180°.

Opening can be restricted, if required, by providing flanges 50 on the box element 10B, for example, as symbolized in chain-dotted line in FIG. 3, through which the box element 10B bears on the boss 37 on the box element 10A.

Figure 14:
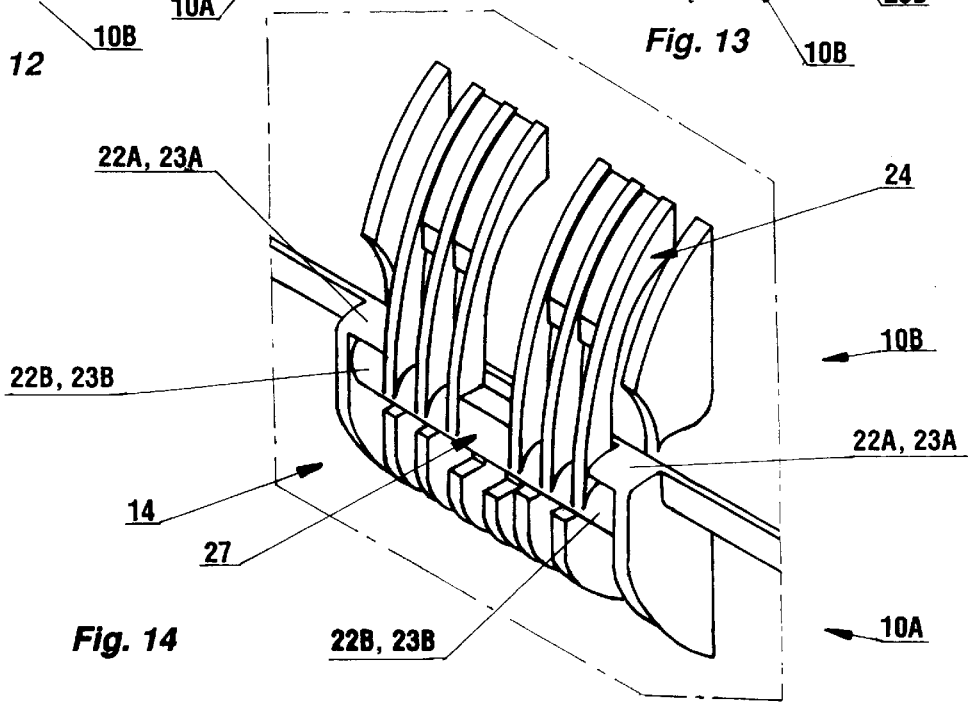
FIG. 14 is a partial perspective view analogous to that of FIG. 2 showing a different embodiment of the invention.

In the simplified embodiment shown in FIG. 14 the journal members 23B of the box element 10B whose clipping members 22B are carried by an elastically deformable arm 24 are in one piece with the respective clipping member 22B.

Otherwise their features are substantially the same as previously described.

Of course, the present invention is not limited to the embodiments described as shown, but encompasses any variant execution and/or combination of their various components.

In particular, the respective roles of the two box elements and/or those of their clipping members or their journal members can be interchanged.

Also, at least the clipping members of each box element could be carried by an elastically deformable arm.

What is claimed is:

1. A box comprising two box elements having a mutual contact surface and opposed assembly areas on opposite sides, one of said box elements having in each of the assembly areas at least one journal member engageable for pivotal movement relative to a complementary journal member on the other of said box elements, a first of said box elements having in each of the assembly areas at least one clipping member releasably engageable with at least one complementary clipping member on a second of said box elements, said at least one clipping member or said at least one of said complementary clipping member being resiliently mounted, said at least one clipping member and said at least one complementary clipping member being separate and distinct from said at least one journal member and said at least one complementary journal member, whereby said box elements being pivotable relative to each other, selectively at either assembly area.

2. A box as claimed in claim 1, further comprising an elastically deformable arm releasably mounting said at least one clipping member or said at least one complementary clipping member.

3. A box as claimed in claim 2, wherein said elastically deformable arm is joined to one of said box elements at a distance spaced from said contact surface, said elastically deformable arm extending cantilever fashion towards said contact surface.

4. A box as claimed in claim 3, wherein said elastically deformable arm is joined to one of said box elements at a distance spaced from said contact surface, said elastically deformable arm extending cantilever fashion to a location beyond said contact surface.

5. A box as claimed in claim 2, wherein said elastically deformable arm comprises three parallel flanges and a cross piece joining said parallel flanges together at their free end.

6. A box as claimed in claim 2, wherein said elastically deformable arm carries said at least one clipping member, said at least one clipping member or said complementary clipping member, having a laterally projecting stud.

7. A box as claimed in claim 6, wherein said journal member comprises a stud projecting laterally on an individual support arm, said stud being coaxial with said laterally projecting stud defining said at least one clipping member.

8. A box as claimed in claim 7, wherein said journal member stud and said clipping member stud extend in opposite directions.

9. A box as claimed in claim 6, wherein said stud has a quarter-circle profile in cross section.

10. A box as claimed in claim 2, wherein said elastically deformable arm carries at an end thereof said at least one clipping member.

11. A box as claimed in claim 10, wherein said at least one complementary clipping member is generally of canopy shape profile and extends substantially parallel to said contact surface.

12. A box as claimed in claim 11, wherein said at least one complementary clipping member has an insertion profile.

13. A box as claimed in claim 11, wherein said at least one complementary clipping member is rigidly connected to said second box element.

14. A box as claimed in claim 2, wherein said elastically deformable arm is in one form and one piece with said at least one clipping member.

15. A box as claimed in claim 2, wherein said elastically deformable arm releasably mounts said at least one clipping member.

16. A box as claimed in claim 2, wherein two said clipping members are disposed at respective ends of said elastically deformable arms at each of said assembly members on said first box element and wherein two said complementary clipping members are provided on said second box element.

17. A box as claimed in claim 16, wherein two said clipping members extend back to back at a free end of said elastically deformable arm.

18. A box as claimed in claim 2, wherein said first box element cooperates with said second box element in a manner of a cover.

19. A box as claimed in claim 2, wherein said elastically deformable arm releasable mounts said at least one clipping member on said first box element and said at least one journal member on said second box element as a rounded shelder at an edge of an insertion passage and the concave side facing a sidewall of said second box element.

20. A box as claimed in claim 1, wherein said journal member comprises a stud projecting laterally on an individually support arm.

21. A box as claimed in claim 20, wherein said support arm of said journal member is rigid.

22. A box as claimed in claim 20, wherein said stud has a generally circular cross section and a flat substantially perpendicular to said contact surface.

23. A box as claimed in claim 1, wherein two journal members are provided at each of said assembly areas on each of said box elements.

24. A box as claimed in claim 1, wherein said two assembly areas are of identical construction.

25. A box comprising two box elements having a mutual contact surface and opposed assembly areas on opposite sides, one of said box elements having in each of the assembly areas at least one journal member engageable for pivotal movement relative to a complementary journal member on the other of said box elements, a first of said box elements having in each of the assembly areas at least one clipping member releasably engageable with at least one complementary clipping member on a second of said box elements, at least one elastically deformable arm carrying said at least one clipping member or said at least one of said complementary clipping member, said at least one clipping member and said at least one complementary clipping member being respectively in one piece with said at least one journal member and said at least one complementary journal member, whereby said box elements being pivotable relative to each other, at selectively at either assembly area.

26. A box as claimed in claim 1, wherein said at least complementary clipping member is generally set back relative to said contact surface.

* * * * *